United States Patent [19]

Win et al.

[11] Patent Number: 4,853,142

[45] **Date of Patent: * Aug. 1, 1989**

[54] HIGH MELTING TEMPERATURE LAUNDRY DETERGENT SHEET

[75] Inventors: Maung H. Win; William D. Lloyd, both of Neenah, Wis.; William A. Abba, Neenah, Wis.; Diego H. Daponte, Woodstock, Ga.

[73] Assignee: Kimberly-Clark Corporation, Neenah, Wis.

[ * ] Notice: The portion of the term of this patent subsequent to Dec. 27, 2005 has been disclaimed.

[21] Appl. No.: 177,567

[22] Filed: Apr. 4, 1988

[51] Int. Cl.[4] ..... C11D 9/42

[52] U.S. Cl. ..... 252/90; 252/90; 252/174; 15/104.93; 15/209 C

[58] Field of Search ..... 252/90, 91; 428/219, 428/220; 15/104.93, 209 R

[56] References Cited

U.S. PATENT DOCUMENTS

| | | | |
|---|---|---|---|
| 4,170,565 | 10/1979 | Flesher et al. | 252/91 |
| 4,307,143 | 12/1981 | Meitner | 252/91 |
| 4,683,001 | 7/1987 | Floyd et al. | 15/104.93 |

*Primary Examiner*—A. Lionel Clingman
*Assistant Examiner*—John F. McNally
*Attorney, Agent, or Firm*—Gregory E. Croft

[57] ABSTRACT

A high melting temperature meltblown web, such as a polyester meltblown web, contains a sufficient amount of condensed liquid detergent to wash a load of laundry and does not exhibit an objectionalbe sticky feel.

17 Claims, 1 Drawing Sheet

HIGH MELTING TEMPERATURE LAUNDRY DETERGENT SHEET

BACKGROUND OF THE INVENTION

Laundry detergents are most commonly available in either liquid or powder form. In order to use such detergents, the user must measure out a certain quantity from a supply bottle or box and pour the measured amount into the clothes washer. In addition, if a fabric softener is desired, the fabric softener must be separately measured or at least separately deposited into the washer or dryer. Such multiple products, containers, and measuring can be messy and, at the very least an inconvenience, particularly for apartment dwellers who must carry all the necessary containers, etc., to the laundry area.

In this regard, the prior art discloses a variety of alternative cleaning products which are intended to provide improved convenience to the consumer. For example, U.S. Pat. No. 4,356,099 to Davies et al. discloses a laundry cleaning product comprising a plastic bag containing a liquid detergent. The bag has a weak seal which is opened by the mechanical action of the washing machine, thereby releasing the liquid detergent.

U.S. Pat. No. 4,188,304 to Clarke et al. discloses a similar detergent product comprising a plastic bag containing a particulate detergent. The bag contains a water-sensitive seal which discharges the contents of the bag when contacted with water.

U.S. Pat. No. 3,686,075 to Morton discloses a sheet substrate containing a fabric softener which is to be preferably used in the clothes dryer, but can also be added to a wash machine during its rinse cycle.

U.S. Pat. No. 4,170,565 to Flesher et al. discloses a laundry product comprising a detergent composition contained between two layers of a water-insoluble permeable substrate such as a polypropylene meltblown web. When contacted by water during the wash cycle, the detergent is dissolved and permeates through the substrate into the wash water. Most significantly, at column 1, lines 56–65, Flesher et al. apparently recognized the potential value of a single layer substrate for delivering laundry detergent, but concluded it was not feasible because of difficulty in loading the substrate with a sufficient amount of detergent and the sticky feel of any product that might be produced.

Therefore there is a need for a laundry cleaning product containing a sufficient premeasured amount of detergent which is convenient to use and economical to manufacture.

SUMMARY OF THE INVENTION

In one aspect, the invention resides in a laundry cleaning product comprising a high melting temperature meltblown web containing at least 1 gram of active liquid detergent solids per gram of meltblown web, preferably about 2 grams or greater. It has been discovered that meltblown webs possess a unique ability to absorb and hold an amount of liquid detergent sufficient to wash a load of laundry and at the same time exhibit a feel that surprisingly is not unpleasantly sticky or tacky. It has also been discovered that in some instances, clothes dryer temperatures significantly exceed temperatures thought to be the upper limit for normal operation. As a result, polypropylene meltblown webs can melt and damage clothing. Therefore it is necessary to raise the melting temperature of the meltblown web above that of polypropylene.

For purposes herein, the high melting temperature meltblown web can be any meltblown web made from a thermoplastic polymer, including copolymers and polymer blends, having a melting point of 170° C. or greater, preferably about 200° C. or greater. A preferred polymer is poly(butylene terephthalate), which has a melting point of about 221° C. Also suitable are polycaprolactam (nylon 6), which melts at 220° C., poly(ethylene terephthalate), which melts at 250° C., and polymethyl pentene, which melts at 240° C. The process for making such meltblown webs is well known in the art and is used extensively for manufacturing a wide variety of commercial nonwoven products. A representative example of the meltblowing process is disclosed in U.S. Pat. No. 3,978,185 to Buntin et al. dated Aug. 31, 1976. For purposes of meltblowing, it is preferred that the apparent viscosity of the polymer as it leaves the die tip be about 500 poise or less, most preferably from about 150 to about 300 poise. Higher apparent viscosities provide low throughputs which are generally unsatisfactory for commercial operation. Increased throughputs can be achieved by lowering the apparent viscosity, which can be lowered either by lowering the molecular weight of the polymer or by raising the temperature of the polymer. It will be appreciated, however, that other meltblowing processes will also produce meltblown webs suitable for purposes of this invention. The meltblown web can be combined with or laminated to other supporting webs, such as spunbonded webs, in order to impart strength or other attributes to the product.

The basis weight for a single sheet of the meltblown webs of this invention can range from about 80 to about 300 grams per square meter. Preferably the basis weight will be from about 110 to about 250, and most preferably about 160 grams per square meter. Basis weights lower than the abovesaid range lack sufficient pore volume to hold the necessary amount of liquid detergent. Basis weights greater than the abovesaid range are too difficult to convert. It is within the scope of this invention, however, to incorporate more than one ply of meltblown web into the product to increase the detergent load.

The size of the meltblown web can be from about 200 to about 2000 square centimeters, preferably from about 600 to about 1,000 square centimeters, and most preferably about 800 square centimeters. The minimum size of the web is limited by the amount of liquid detergent the web can absorb and hold. The maximum size is determined by consumer acceptance, convenience and packaging considerations. It is preferred that the meltblown web be pattern bonded to maintain integrity during use. Pattern bonding is commonly performed during manufacture of meltblown webs by hot embossing or ultrasonic bonding of the newly formed web. The product can be dispensed in sheet form or from perforated rolls. In addition, the single sheets can be perforated to be torn in half for half loads of laundry.

The liquid detergents useful for making the products of this invention can be any liquid detergent which is suitable for cleaning laundry. As is well known in the detergent arts, these detergents typically contain a large number of components such as surfactants, solubilizers, pH adjusters, fragrances, brighteners, dyes, anti-redeposition compounds, and builders. For purposes of processing, as will be explained herein, it is preferable that the liquid detergent contain at least 60 weight percent active detergent solids in order to minimize drying costs, although liquid detergents having at least 25 weight percent solids are suitable. The resulting condensed liquid detergent has a liquid detergent formulation solids content of about 80 weight percent or more.

The amount of active liquid detergent solids provided by the condensed liquid detergent must be at least 1 gram per gram of meltblown web, preferably from about 2 to about 5 grams per gram and most preferably from about 3 to about 4 grams per gram. The amount of active detergent solids retained by the meltblown web has been measured to be as high as about 12 grams per gram and will depend upon the detergent formulation, the extent to which it is condensed, the basis weight and area of the web, and the pattern bonding area of the web. The capacity of the web to hold detergent will decrease as the pattern bonding area is increased. Hence it is necessary to strike a balance between detergent capacity and web integrity during use. Generally, the pattern bonding area can range from about 5 to about 40 percent of the total surface area of the web, with from about 10 to about 20 percent being preferred, and about 15 percent being most preferred.

It is preferred that the meltblown web also contain a fabric softener which softens the laundry during the drying cycle. Webs impregnated with such softening agents are well known in the art and are well known commercial products. Suitable fabric softening agents include those described in U.S. Pat. No. 3,686,025 to Morton, dated Aug. 22, 1972.

DETAILED DESCRIPTION OF THE DRAWING

Figure 1:
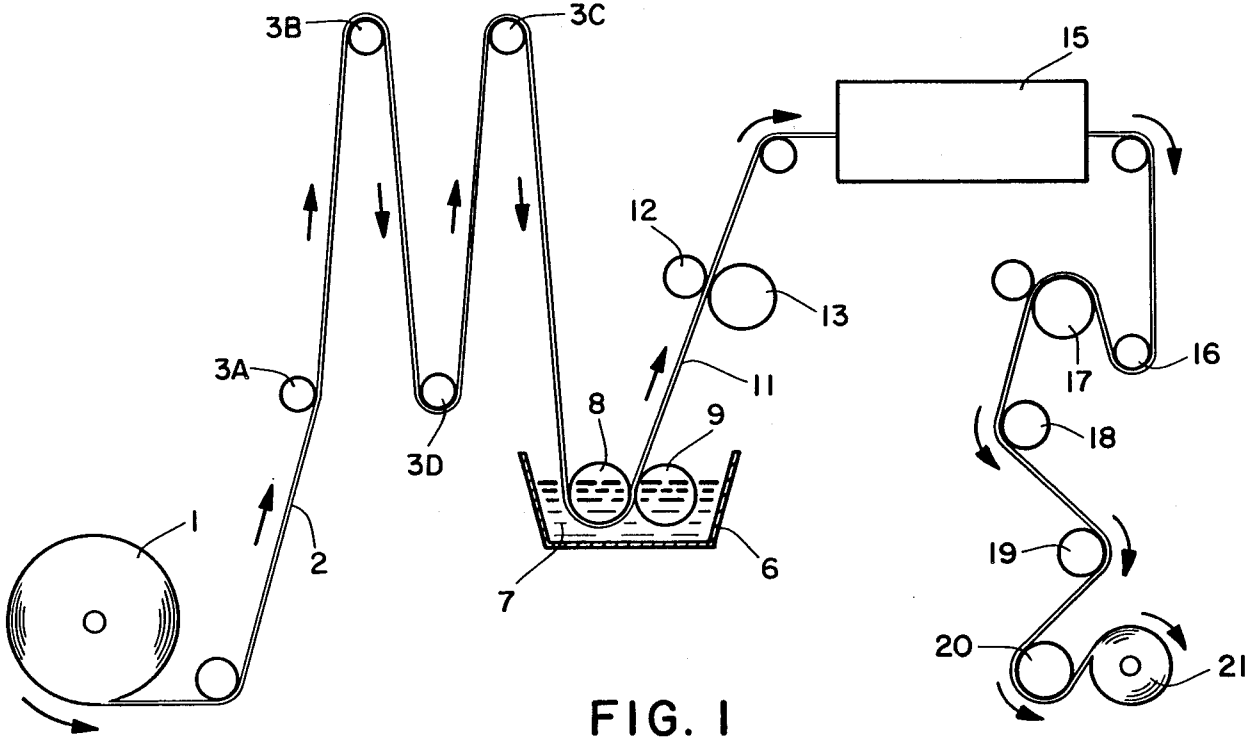
FIG. 1 is a schematic view of a process for making the product of this invention.

Directing attention to FIG. 1, shown is a supply roll 1 of the meltblown web to be saturated with liquid detergent. Preferably the web has been thermally pattern-bonded to provide sufficient integrity to withstand a wash and dry cycle without disintegrating. The web 2 is passed through a series of tension control rolls 3A, 3B, 3C, and 3D and fed to the saturation station 5. The saturation station consists of a tray 6 filled with liquid detergent 7 and a guide roll 8 which submerses the web. The space between the guide roll and the metering roll is set in order to control the amount of add-on to the web. The residence time of the web in the liquid detergent is short but sufficient to substantially saturate the web. Generally residence times on the order of one or two seconds are suitable.

After leaving the saturation station, the saturated web 11 passes through a controlled nip between nip rolls 12 and 13 which serves to squeeze out excess liquid and provide an additional degree of control over the amount of liquid contained within the web and its even distribution throughout.

The saturated web then passes through a dryer 15, preferably an air flotation dryer, which removes substantially all (up to about 95 percent) of the available moisture to condense the liquid detergent. The product leaving the dryer contains concentrated liquid detergent having a gel-like consistency, yet the web feels dry to the touch.

After drying, the dried web passes around a tension control roll 16, a pull roll 17, a slitter roll 18, a Mount Hope roll 19, and a rewind drive roll 20. The web is thereby wound onto the rewind roll 21 for subsequent converting and packaging operations.

It will be appreciated that the foregoing discussion, given for purposes of illustration, is not to be construed as limiting the scope of this invention.

We claim:

1. A laundry cleaning product for washing a load of laundry comprising a meltblown web containing at least 1 gram of active liquid laundry detergent solids per gram of meltblown web, said meltblown web comprising a thermoplastic polymer having a melting point of 170° C. or greater.

2. The product of claim 1 wherein the melting point of the thermoplastic polymer is 200° C. or greater.

3. The product of claim 2 wherein the basis weight of the meltblown web is from about 80 to about 300 grams per square meter.

4. The product of claim 3 wherein the amount of active liquid detergent solids is from about 2 to about 5 grams per gram of meltblown web.

5. The product of claim 3 wherein the amount of active liquid detergent solids is about 3 grams per gram of meltblown web.

6. The product of claim 4 wherein the size of the meltblown web is from about 200 to about 2,000 square centimeters.

7. The product of claim 4 wherein the size of the meltblown web is from about 600 to about 1000 square centimeters.

8. The product of claim 6 wherein the meltblown web is pattern bonded, wherein the bonding area is from about 5 to about 40 percent of the meltblown web surface area.

9. The product of claim 8 wherein the bonding area is from about 10 to about 20 percent of the meltblown web surface area.

10. The product of claim 1 wherein the thermoplastic polymer is poly(ethylene terephthalate).

11. The product of claim 1 wherein the thermoplastic polymer is polycaprolactam.

12. The product of claim 1 wherein the thermoplastic polymer is poly(butylene terephthalate).

13. The product of claim 1 wherein the thermoplastic polymer is polymethyl pentene.

14. A laundry cleaning product comprising a pattern-bonded meltblown web having a basis weight of about 160 grams per square meter, wherein the web contains from about 2 to about 4 grams of active liquid detergent solids per gram of web and wherein the bonded area is about 15 percent of the surface area of the web, said meltblown web comprising a thermoplastic polymer having a melting point of 200° C. or greater.

15. The product of claim 14 wherein the thermoplastic polymer is poly(ethylene terephthalate).

16. The product of claim 14 wherein the thermoplastic polymer is poly(butylene terephthalate).

17. The product of claim 14 wherein the thermoplastic polymer is polymethyl pentene.

* * * * *